US006461181B1

(12) United States Patent
Goh et al.

(10) Patent No.: US 6,461,181 B1
(45) Date of Patent: Oct. 8, 2002

(54) DOCKING INTERFACE FOR PORTABLE DEVICE

(75) Inventors: Siang Thia Goh, Singapore (SG); Eng Kim Teo, Singapore (SG); Wee Chong Ou, Singapore (SG)

(73) Assignee: Creative Technology Ltd. (SG)

( * ) Notice: Subject to any disclaimer, the term of this patent is extended or adjusted under 35 U.S.C. 154(b) by 0 days.

(21) Appl. No.: 09/712,035

(22) Filed: Nov. 14, 2000

(30) Foreign Application Priority Data

Nov. 15, 1999 (SG) ..... 9905663

(51) Int. Cl.[7] ..... H01R 25/00; H01R 9/22; H01R 13/73

(52) U.S. Cl. ..... 439/289; 439/929

(58) Field of Search ..... 439/513, 357, 439/347, 296, 298, 289, 929, 500, 700; 429/99, 100

(56) References Cited

U.S. PATENT DOCUMENTS 5,052,943 A * 10/1991 Davis ..... 439/357

6,002,236 A * 12/1999 Trant et al. ..... 320/114

* cited by examiner

*Primary Examiner*—Khiem Nguyen
*Assistant Examiner*—Chandrika Prasad
(74) *Attorney, Agent, or Firm*—Jon A. Gibbons; Fleit, Kain, Gibbons, Gutman & Bongini P.L.

(57) ABSTRACT

The present invention is a docking interface for portable electronic devices that feature at least a printed circuit board (PCB) contact and a set of spring loaded contact pins for facilitating the recharging of power source and transfer of data between the devices and their hosts. Because of the thickness of a PCB and the retraction of the spring loaded pins, the overall profile of the present invention is reduced to a minimum. At the same time, the reliability of the contact between the portable device and the docking station is assured. As such, the present invention offers an economical and reliable solution for docking interface in portable electronic devices that permit further reduction in size and weight without imposing constraints on the availability of increased functionality.

11 Claims, 5 Drawing Sheets

DOCKING INTERFACE FOR PORTABLE DEVICE

FIELD OF THE INVENTION

The present invention relates to a low profile interface for portable electronic devices. In particular, the present invention pertains to a low profile, versatile and reliable interface for docking portable electronic devices with a docking station to facilitate recharging of power source, auxiliary power and transfer of data.

BACKGROUND OF THE INVENTION

Portable electronic devices such as cellular telephones, electronic organizers and lately audio players have achieved reduction in size and weight while offering increased functions as a result of advances in semiconductor designs. A bottle neck to further miniaturization in portable electronic devices is the availability of reliable and low profile docking interface for the purposes of recharging of power source and transfer of data. At the same time, the incentive to reduce the size and weight continues to grow for portable electronic devices.

Existing docking interfaces for portable electronic devices comprises of well known male and female connectors whose high profile poses severe constraints in size reduction and design consideration. Other existing docking interface for portable electronic devices are less reliable as the contacts are exposed to the ambient environment and electrical connectivity is not assured after repeated usage.

OBJECT OF THE INVENTION

It is an object of the present invention to feature a low profile and reliable docking interface for portable electronic devices in order to meet size and weight design considerations.

It is a further object of the present invention to feature a low profile and reliable docking interface for portable electronic devices to facilitate the recharging of power source and transfer of data.

It is yet another object of the present invention to feature a low profile and reliable docking interface for portable electronic devices that are not only economical but also sourceable readily.

SUMMARY OF THE INVENTION

The present invention is a docking interface for portable electronic devices that feature at least a printed circuit board (PCB) contact and a set of spring loaded contact pins for facilitating the recharging of power source and transfer of data between the devices and their hosts. Because of the thickness of a PCB and the retraction of the spring loaded pins, the overall profile of the present invention is reduced to a minimum. At the same time, the reliability of the contact between the portable device and the docking station is assured. As such, the present invention offers an economical and reliable solution for docking interface in portable electronic devices that permit further reduction in size and weight without imposing constraints on the availability of increased functionality.

DETAILED DESCRIPTION OF THE INVENTION

Figure 1:
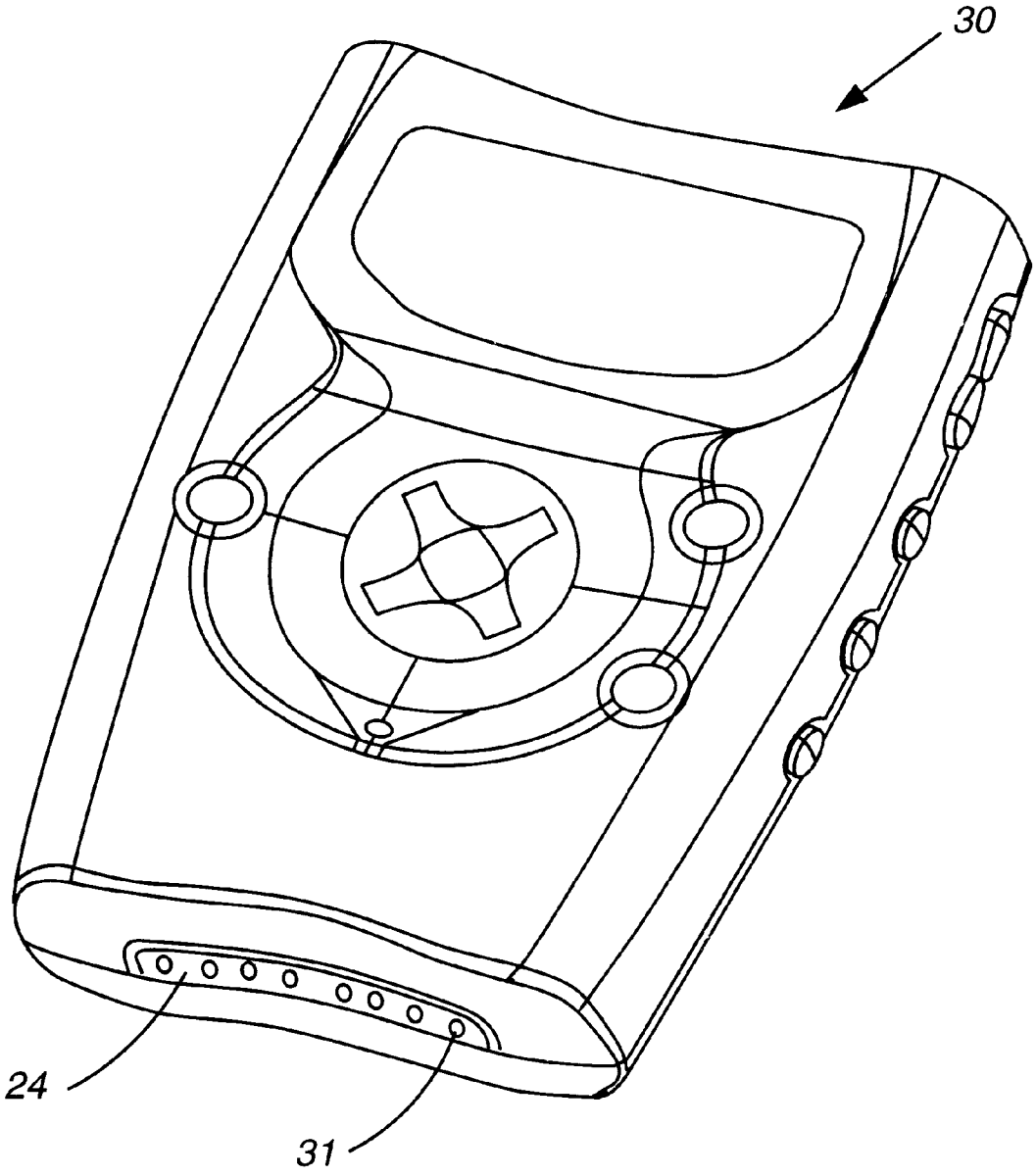
FIG. 1 is a top, right side, elevational and perspective view of a portable electronic device incorporating the present invention.

FIG. 1 is a top, right side. elevational and perspective view of a portable electronic device 30 incorporating the present invention. It is a device for downloading compressed audio data; the device also records such data and replays the uncompressed data. Like most modern portable electronic devices, the portable device 30 is compact, lightweight and versatile. It fits neatly in the palm of any user, and the controls and key buttons enable the user to activate various functions by maneuvering the fingers of one's hand. As will be elaborated in the detailed description of FIGS. 1 to 3, the portable electronic device 30 achieves its size and weight by overcoming the limitations of prior art docking interface.

Figure 2:
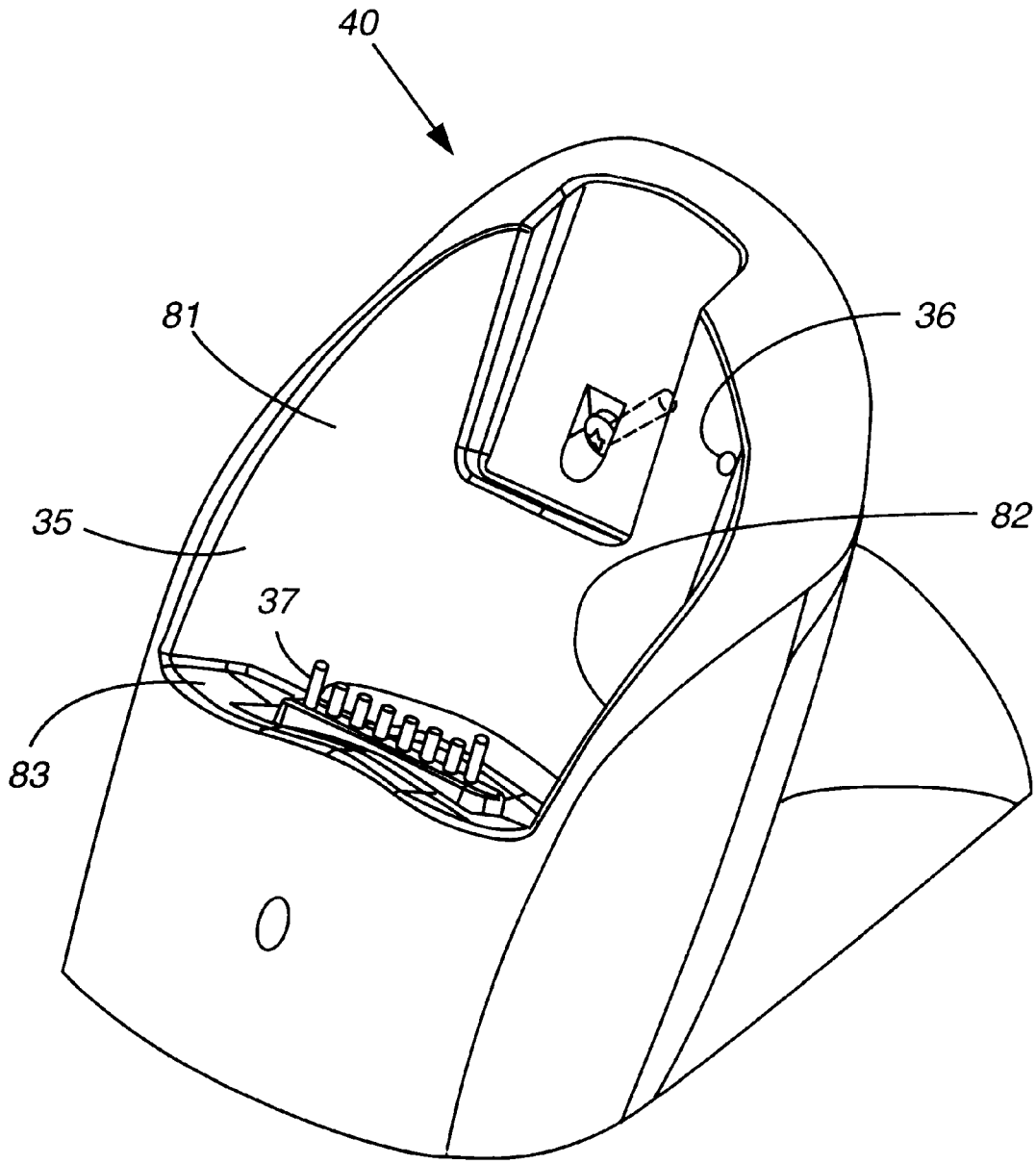
FIG. 2 is a top, right side, elevational and perspective view of a docking station incorporating the present invention.
Figure 4:
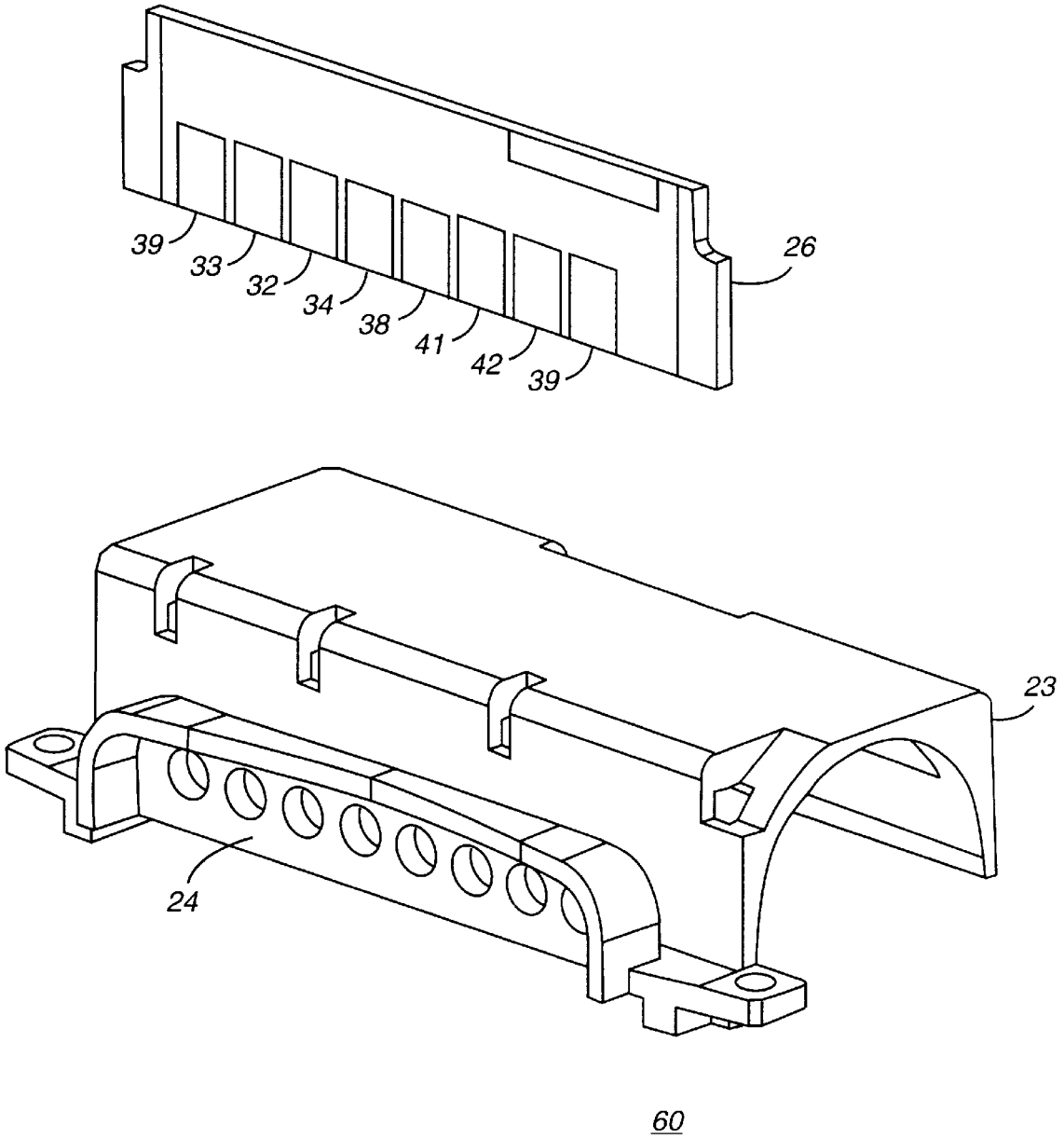
FIG. 4 is a top, right side, elevational and perspective view of the PCB contact and the cover docking of the present invention.

Referring again to FIG. 1, the portable device 30 features at the bottom a docking base 24 with a plurality of openings 31 for exposing a plurality of contacts of a docking PCB 26 (See, FIG. 4 for details). The portable electronic device 30 cooperates with a docking station 40 as illustrated in FIG. 2. The docking station 40 comprises a receptacle 35 tat contours the rear, side and bottom portions of the portable electronic device 30. A series of spring loaded contacts 37 disposed at the bottom of the receptacle 35 mate with the docking PCB 26 of the portable electronic device 30 for providing auxiliary power, recharging the power source and transferring data between the device 30 and a host (not shown but understood). The docking PCB 26 and the spring loaded contacts 37 comprise one of the novel features of the present invention. By docking PCB, the present invention refers to a general class of thin film contacts for achieving low profile interface in electronic devices. The present invention envisages the PCB to be either rigid or semi rigid.

In FIG. 2, a lock pin 36 is disposed near the top portion of the receptacle 35 of the docking station 30 for fixing the portable electronic device 30 (not shown but understood) onto the spring loaded contacts 37. Without the lock pin 36, the docking PCB 26 does not engage the spring loaded contacts 37 on each and every occasion. The docking station 30 includes a rear surface 81, a side surface 82, and a bottom surface 83 which is contoured to receive the portable device 30.

Figure 3:
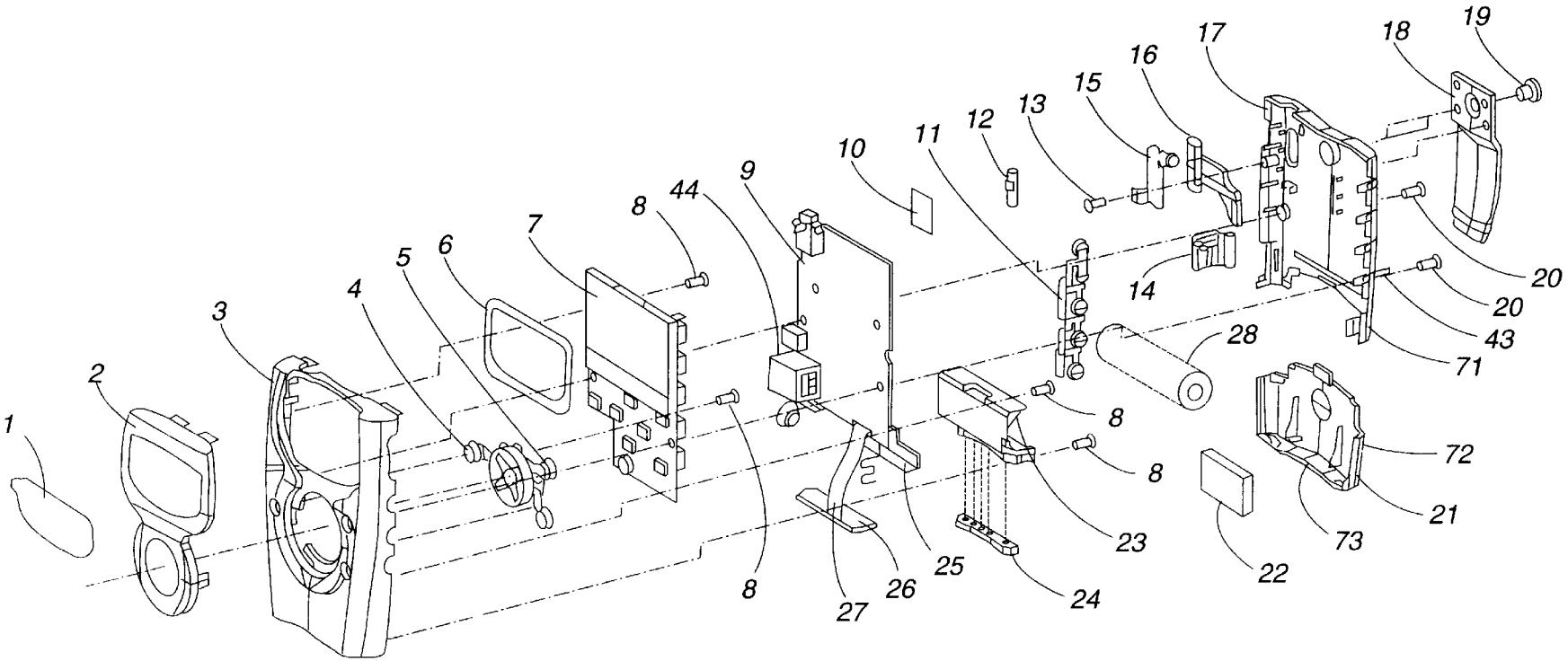
FIG. 3 is top, right side, elevational and exploded perspective view of the various components of the portable device in FIG. 1.

FIG. 3 is top, right side, elevational and exploded perspective view of the various components of electronic portable device 30 as shown FIG. 1. The portable electronic device 30 comprises a front cab 3, a rear cab 17, a battery cover 21, printed circuit boards 7 and 9, key and function pads 4 and 5, the docking PCB 26 coupled with the printed circuit boards with a flexible cable 27, a docking cover 23 that doubles as a battery compartment, a docking cover 74 and a plurality of knobs and controls 11, 12, and 16. The portable electronic device 30 further comprises a Universal Serial Bus (USB) jack 44 disposed on the print circuit board 9 for interfacing with a personal computer or similar controller. Through the USB jack, compressed audio data such as MP3 music is downloaded onto the device 30 and subsequently replayed. A battery 28 provides power source for the portable electronic device 30. Again FIG. 3, protective covers such as a LCD panel 2, a LCD cushion 6, a USB cover 14 are also provided to secure critical areas of the printed circuit board. As mentioned above, a lock pin 36 disposed on docking station 40 fixes the portable electronic device 30 onto the receptacle 35. An opening 43 which mates with the lock pin 36 is disposed on the rear cab 17 for accomplishing this task. Optionally, a belt clip 18 may be affixed.

FIG. 4 is a top, right side, elevational and perspective view of the docking PCB 26 and the docking cover 23 of the present invention. Not shown but understood by one skilled in the art is the flexible cable that connects the print circuit board and the docking PCB. The docking cover 23 receives the battery 28 (not shown) that provides the power source of the portable electronic device 30 when it is not being recharged. In the preferred embodiment of the present invention, the docking PCB 26 features eight contact pads 32,33,34,38,39,41 and 42 respectively. Contacts 32, 34, 38 and 41 are for facilitating the transfer of signals, while contacts 33 and 42 are for the terminals of the battery 28 (not shown). Finally, contacts 39 are the power and ground contacts of the device 30. The docking base 24 is coupled to the exterior facing of the docking cover 23 for providing protective cover for the docking PCB 26.

As shown in drawings, particularly FIG. 1 element 31, FIG. 2 element 37 and FIG. 4 elements 32, 33, 34, 38, 39, 41, and 42, the number of contacts in one embodiment are eight. It is important to note that any number of contacts are possible as is understood by those skilled in the art. In one embodiment the number of contacts 37 on the docking station 30 and the number of contact of the docking base 24 with flexible card 26 are identical. In another embodiment, the number of contacts 37 on the docking station 30 and the number of contacts on the docking base 24 are different. In other words, the number of contacts on the docking base 24 are a sub-set of the number of contacts 37 on the docking station 30 and vice-versa.

Figure 5:
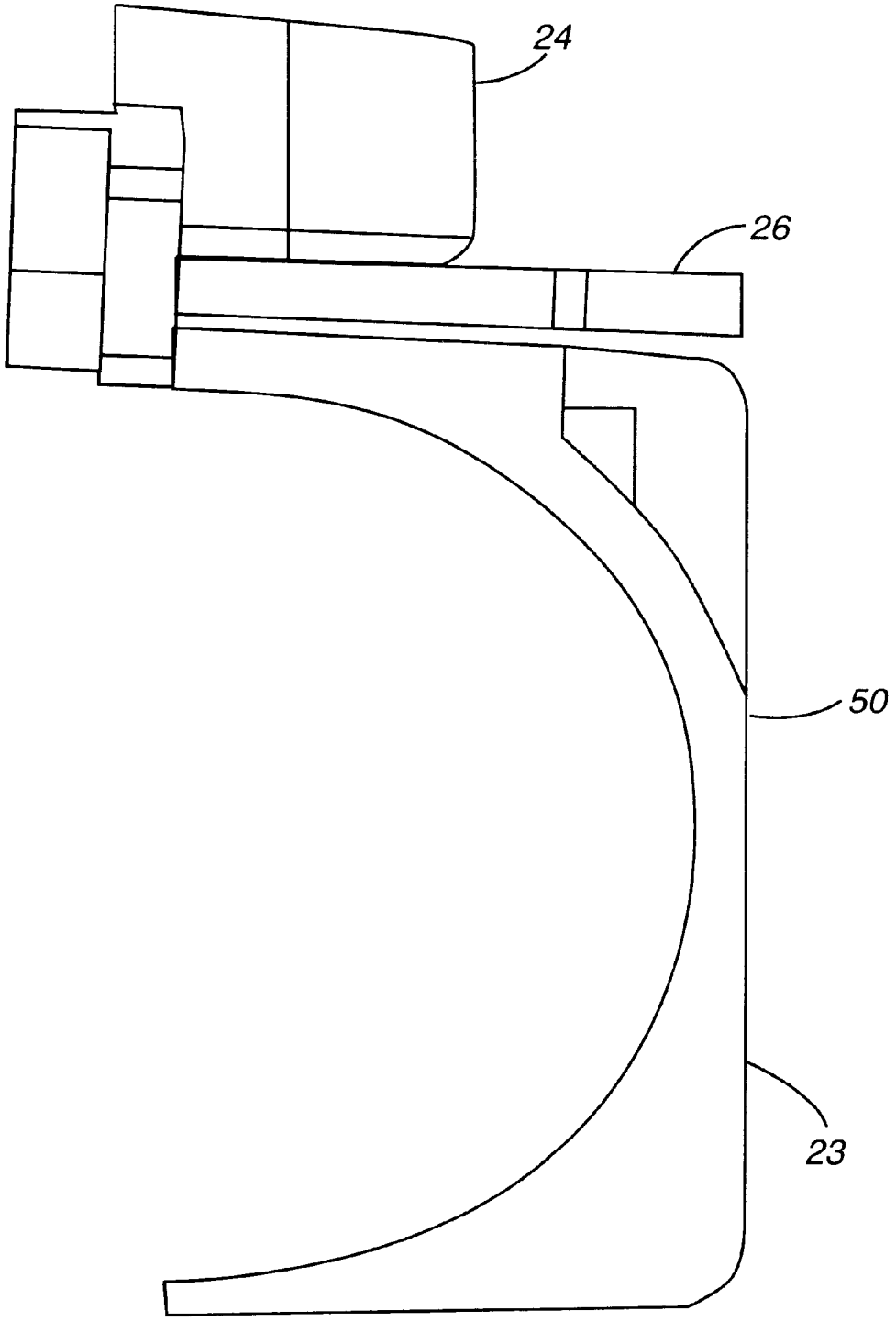
FIG. 5 is: aright side, plan view of the PCB contact and the cover docking in FIG. 4.

FIG. 5 is a right side, plan view of the docking PCB and the docking cover in FIG. 4. When the portable electronic device 30 is fully assembled, the docking PCB is disposed in a narrow gap of about 1.1 mm between the docking cover 23 and the docking base 24. The docking cover 23 has an exterior facing 50. The applicant has found it virtually impossible to identify a prior art connector or interface that will provide such as low profile and reliable interface for the device 30 until it came up with the present invention. The present invention may be embodied in other specific forms without departing from the spirit or essential characteristics thereof. The presently disclosed embodiments are, therefore, to be considered in all respects as illustrative and not restrictive, the scope of the invention being indicated by the appended claims and all changes which come within the meaning and range of equivalency of the claims are, therefore, to be embraced therein.

We claim:

1. A portable device comprising:

a low profile docking interface for mating with an external docking station, the docking interface including:

at least one docking printed circuit board, the docking printed circuit board having a plurality of thin-film contact pads for electrically coupling directly with one or more contact pins formed in the external docking station for transferring signals and power therebetween;

a docking cover; and a docking base coupled with the docking cover with a narrow gap therebetween, in which the docking printed circuit board is mounted, the docking base being coupled to an exterior facing of the docking cover so that the docking cover and the docking base provides a protective cover for the docking panted circuit board;

wherein the docking cover doubles as a battery compartment.

2. A portable device as claimed in claim 1, wherein the contact pads are at an end of the docking printed circuit board.

3. A portable device as claimed in claim 1, wherein the docking base has a plurality of opening therethrough for exposing the plurality of thin-film contact pads, the number of openings being the same as the number of thin-film contact pads.

4. A portable device as claimed in claim 2, wherein the docking base has a plurally of openings therethrough for exposing the plurality of thin-film contact pads, the number of openings being the same as the number of thin-film contact pads.

5. A portable device as claimed in claim 4, wherein the contact pads are at an end of the docking printed circuit board.

6. A low profile docking interface for a portable device for docking with an external docking station, the low profile docking interface comprising:

a docking printed circuit board with one or more tin film contact pads for electrically coupling directly with one or more contacts formed in an external docking station for transferring signals and power therebetween;

a docking cover with an exterior facing; and a docking base coupled to the exterior facing of the docking cover with tho docking printed circuit board being mounted in a narrow gap formed between the docking cover and the docking base for providing a protective cover for the docking printed circuit board;

wherein the docking cover doubles as a battery compartment.

7. A docking interface as claimed in claim 6, wherein the contact pads are at an end of the docking printed circuit board.

8. A docking interface as claimed in claim 6, wherein the docking base has a plurality of openings therethrough for exposing the plurality of thin-film contact pads, the number of openings being the same as the thin-film contact pads.

9. A docking interface as claimed in claim 8, wherein the contact pads are at an edge of the docking printed circuit board.

10. A docking station for use with a portable device, the portable device having a rear portion, a side portion, and a bottom portion, the docking interface comprising:

a docking printed circuit board with one or more thin film contact pads;

a docking cover with an exterior facing; and a docking base coupled to the exterior facing of the docking cover with the docking printed circuit board being mounted in a narrow gap formed between the docking cover and the docking base for providing a protective cover for the docking printed circuit board;

wherein the docking cover doubles as a battery compartment;

wherein the docking station includes a receptacle with a rear surface, a side surface and a bottom surface, the rear surface, the side surf and the bottom surface contouring the rear portion, the side portion, and the bottom portion of the portable device, the receptacle having a pin disposed adjacent to a top portion of the receptacle for fixing the portable device in the receptacle and in such a manner that the contact pads electrically couple directly with one or more spring loaded contacts mounted in the bottom surface of the receptacle.

11. A docking station as claimed in claim 10, wherein the receptacle has an open front.

* * * * *